United States Patent [19]

Fujimoto

[11] 4,185,198

[45] Jan. 22, 1980

[54] MEANS FOR GENERATING AN X-RAY EXPOSURE COMMAND IN RESPONSE TO A VIDEO SIGNAL COMPONENT

[75] Inventor: Yuichi Fujimoto, Yokohama, Japan

[73] Assignee: Tokyo Shibaura Electric Co., Ltd., Kawasaki, Japan

[21] Appl. No.: 811,847

[22] Filed: Jun. 30, 1977

[30] Foreign Application Priority Data

Jul. 8, 1976 [JP] Japan ..... 51-80418

[51] Int. Cl.[2] ..... H05G 1/30

[52] U.S. Cl. ..... 250/416 TV; 358/111

[58] Field of Search ..... 250/416 TV; 358/111

[56] References Cited

U.S. PATENT DOCUMENTS

| | | | |
|---|---|---|---|
| 3,009,079 | 11/1961 | Jacobs | 250/416 TV |
| 3,257,506 | 6/1966 | Siepmann | 250/416 TV |
| 3,580,997 | 5/1971 | Webb et al. | 250/416 TV |
| 3,824,399 | 7/1974 | Björk et al. | 250/416 TV |
| 3,924,064 | 12/1975 | Nomura et al. | 250/416 TV |
| 3,996,420 | 12/1976 | Geluk | 250/416 TV |

*Primary Examiner*—Alfred E. Smith

*Assistant Examiner*—T. N. Grigsby

*Attorney, Agent, or Firm*—Cushman, Darby & Cushman

[57] ABSTRACT

An X-ray apparatus for diagnosis which utilizes an X-ray television device includes a video circuit for setting a particular area of an X-ray image, a video gate circuit for selecting a corresponding signal component from a video signal representative of the X-ray image, a command pulse generator adapted to detect a variation in level of the video signal as caused by a contrast medium and generate an X-ray exposure command pulse when the signal level exceeds a threshold level, and a pulse shaping circuit for generating timing pulses for these circuits. The particular area of the X-ray image is set by the operator while observing the X-ray image on the TV monitor. When a patient drinks the contrast medium of barium and at the same time an operator depresses a start switch for photographing the apparatus detects the variation in level of the video signal as caused by barium to permit the X-ray exposure command signal to be issued for photographing so that the predetermined area of the X-ray image can be automatically photographed.

10 Claims, 11 Drawing Figures

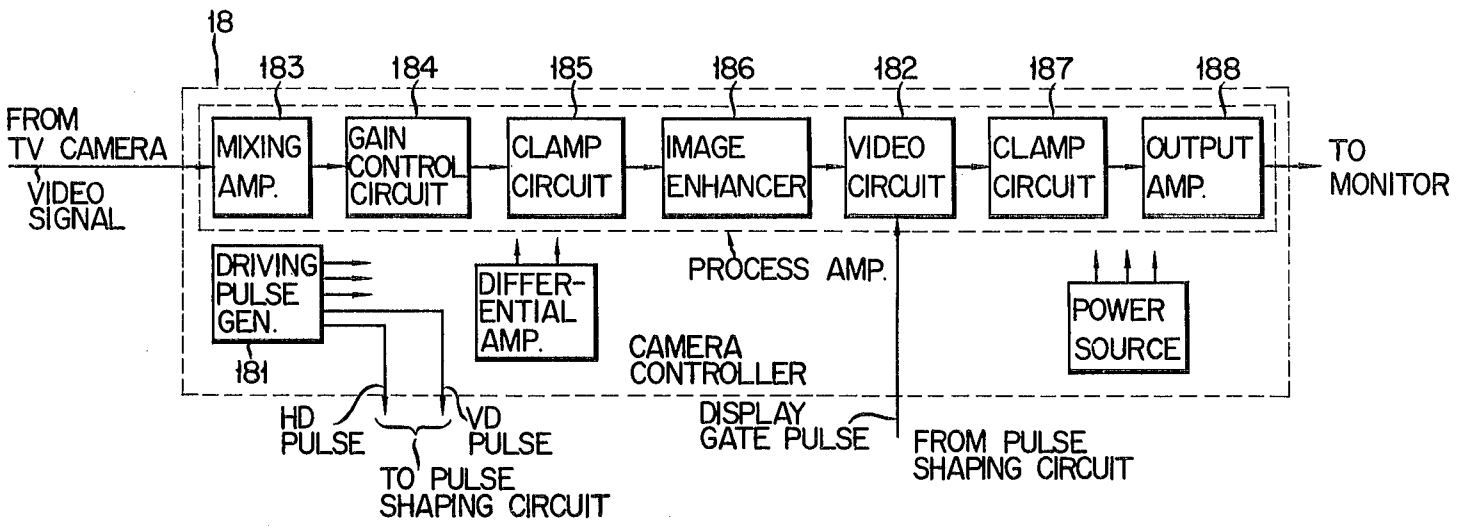
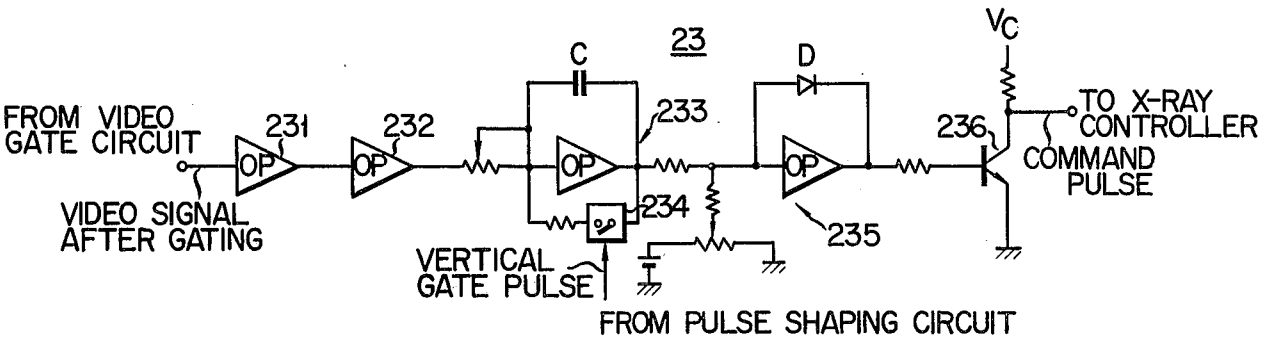
FIG. 7

MEANS FOR GENERATING AN X-RAY EXPOSURE COMMAND IN RESPONSE TO A VIDEO SIGNAL COMPONENT

BACKGROUND OF THE INVENTION

This invention relates to an X-ray apparatus for diagnosis and in particular an X-ray apparatus for effecting an automatic X-ray photographing using an X-ray television device.

X-ray apparatus is known for use in the medical field for diagnostics is adapted to expose a patient to X-rays and send the X-rays which penetrate through the patient to an X-ray film to obtain an X-ray image. X-ray apparatus is also well known which can obtain a dynamic X-ray image using a so-called X-ray television device adapted to convert an X-ray image from a patient to an optical image for display on a television monitor. Such an X-ray apparatus is disclosed in U.S. Pat. No. 3,622,786.

A known method is often used by which an X-ray photograph is taken at a proper X-ray exposure timing while observing an X-ray image through a fluoroscope. According to this method an X-ray image corresponding to a region of interest (hereinafter called ROI) in a patient can be obtained by alternately manually effecting a fluoroscopic examination of an X-ray image and an X-ray exposure for photographing. It is, however, difficult to X-ray photograph RCI of a patient, such as a esophagus, through which a contrast medium (for example, barium) is passed at high speed. The reason is that because an X-ray exposure command for photographing such ROI of the patient is given by a manual operation of an operator it is difficult to obtain the timing at which such a command must be imparted. In consequence, the quality of the photograhy is greatly dependent upon the skill of the operator. since the timing at which an excellent X-ray photograph is obtained is momentary in nature, the operator must constantly observe an X-ray image on the TV monitor, while in a state of high tension, thus imparting agreat burden to the operator. Furthermore, it is difficult to judge the timing at which an excellent X-ray photograph is gained. If such a timing is improper, a photographing operation must be repeated again and again. As a result, the patient is exposed to an excessive dosage of X-ray, thus involving a eventual safety problem.

SUMMARY OF THE INVENTION

An object of this invention is to provide an X-ray apparatus for diagnosis, in which ROI of a patient, through which a contrast medium is passed at high speed, can be X-ray photographed utilizing an X-ray image on an X-ray television device.

Another object of this invention is to provide an X-ray apparatus in which of a patient, through which a contrast medium is passed, can be positively X-ray photograhed at a proper timing.

According to a broader aspect of this invention there is provided an X-ray apparatus comprising video circuit means for designating and setting on an X-ray television device any particular area of an X-ray image which is sent from a subject to be X-ray photographed; gate means for selecting a predetermined signal component from a video signal corresponding to the X-ray image; signal detection means for detecting a variation of the selected video signal component and generating an X-ray exposure command signal when the variation of the video signal component reaches a predetermined level.

The X-ray apparatus according to this invention utilizes an X-ray television device adapted to convert an X-ray image passed through ROI of a patient to a optical image for display on a television monitor. A proper timing at which ROI of the patient, such as an esophagus and blood vessels of the heart, etc., through which a contrast medium is passed at high speed, is X-ray photographed is detected utilizing a variation in level of a video signal as caused by the contrast medium. As a result, ROI of the patient can be automatically photographed without fail. The X-ray apparatus can be easily operated without any skill, permitting an excellent X-ray image to be photographed without fail.

The other features and advantages of this invention will be understood in connection with a detailed explanation which follows:

BRIEF DESCRIPTION OF THE DRAWING

FIG. 2 is a block diagram explaining the operation of a camera controller shown in FIG. 1;

FIG. 7 is a detailed circuit diagram showing a command pulse generator shown in FIG. 1;

DETAILED DESCRIPTION OF THE PREFERRED EMBODIMENTS

Figure 1:
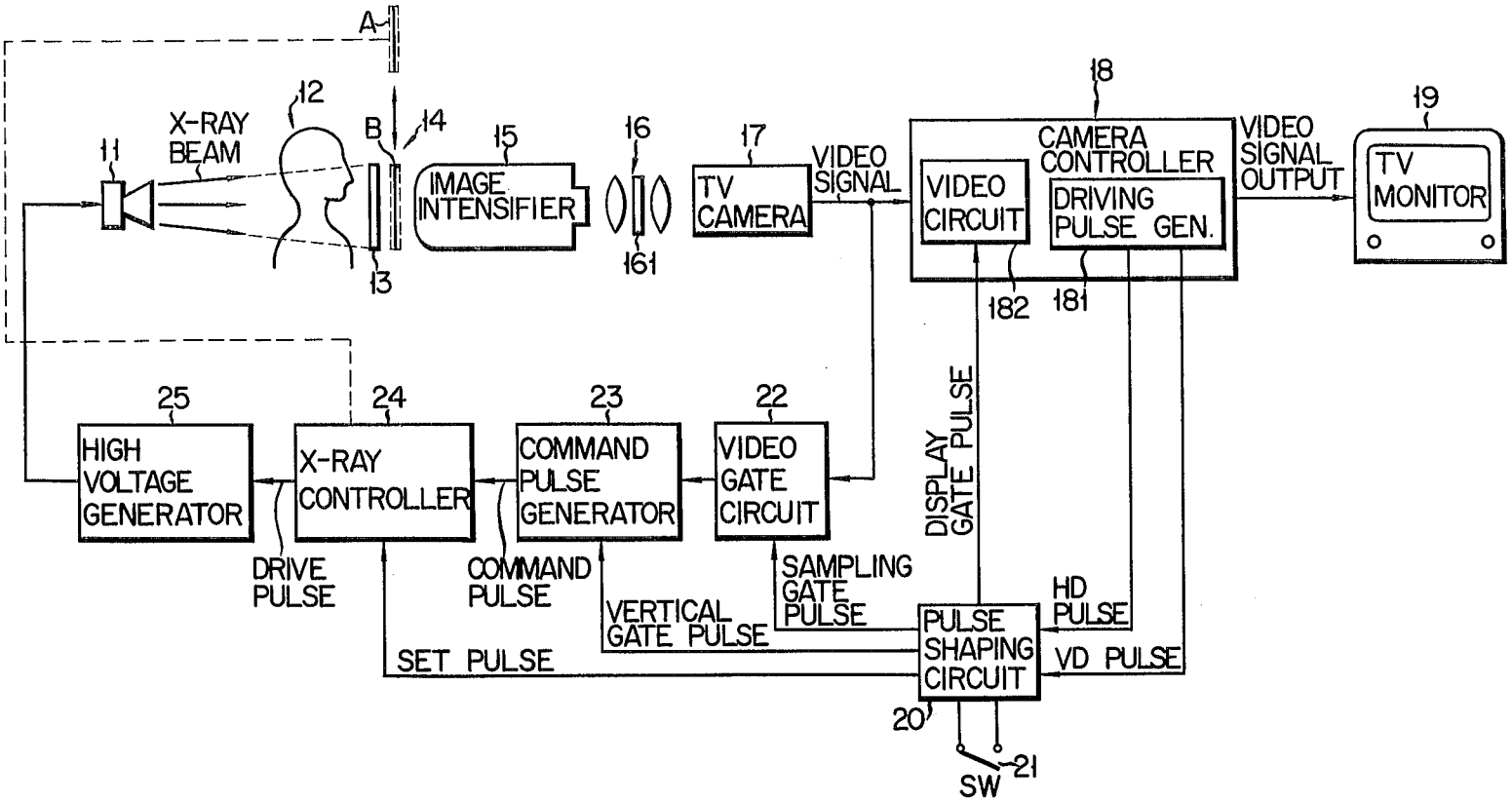
FIG. 1 is a systematic block diagram showing a X-ray apparatus according to the embodiment of this invention.
Figure 3:
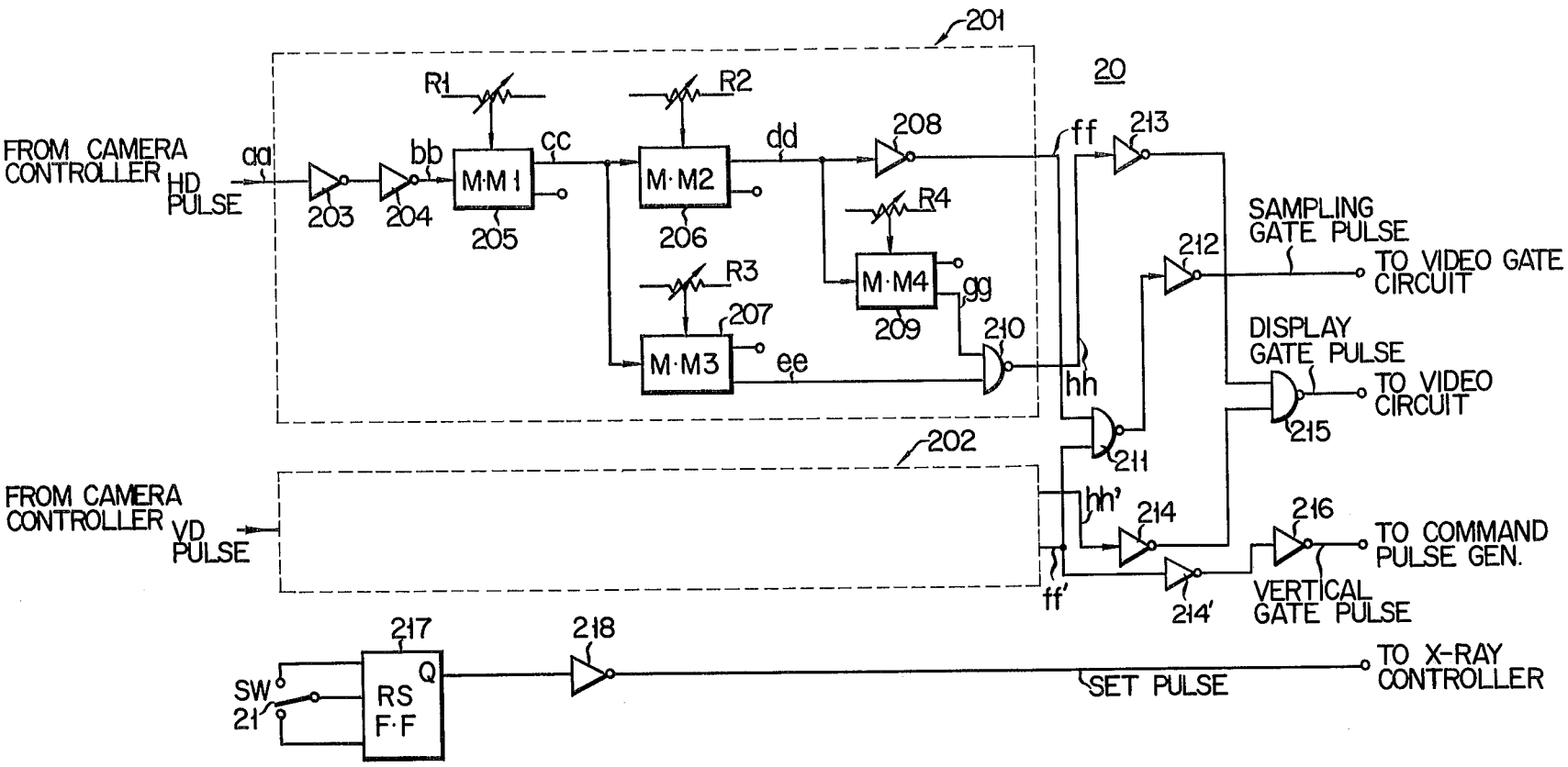
FIG. 3 is a detail circuit diagram showing a pulse shaping circuit shown in FIG. 1.
Figure 4:
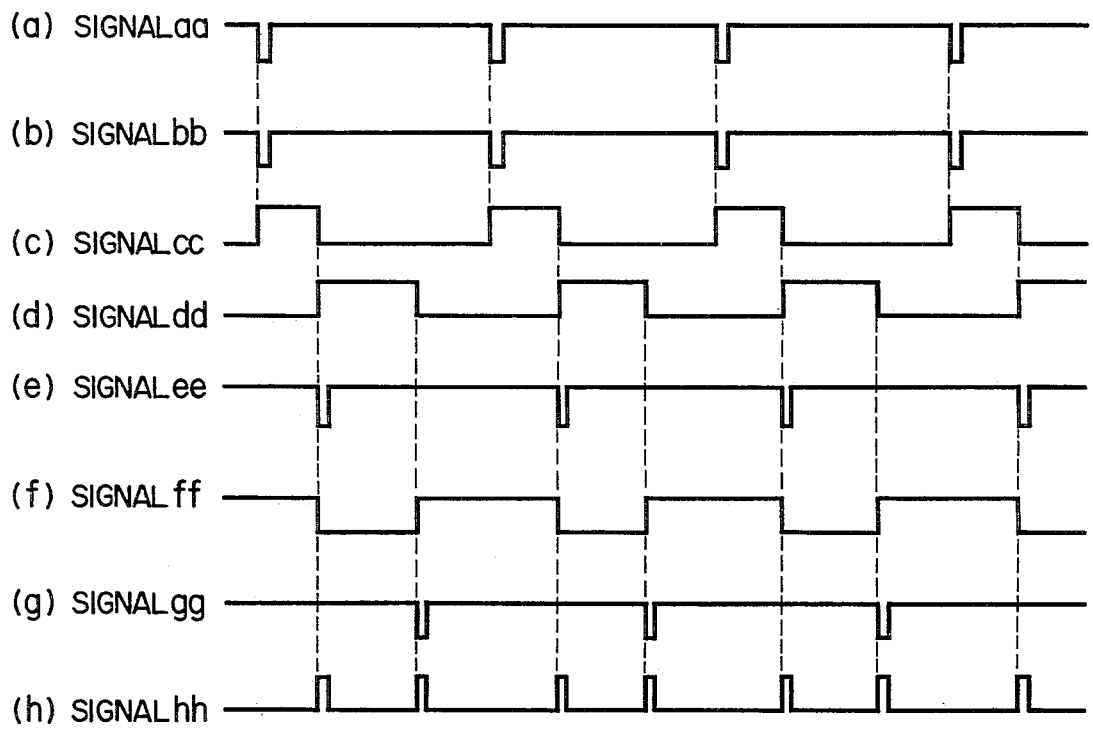
FIG. 4 is a time chart for explaining the circuit shown in FIG. 3.

FIG. 1 shows a schematic diagram of an X-ray apparatus for diagnosis. An X-ray beam emitted from an X-ray tube 11 is penetrated through a subject 12 and then through a scattering ray eliminating grid 13 to an image intensifier 15 where an optical image is formed. The optical image is passed through a lens system 16 and picked up by a television camera 17. An image signal corresponding to the picked-up optical image is fed through a camera controller 18 to a TV monitor 19 (usually a TV receiver) where a corresponding X-ray image is displayed on the fluorescent screen. Since in this case a monitor operation is effected through an X-ray image observation, an X-ray film (cassette) 14 is in a "wait" position A withut X-ray radiation. The X-ray television device for dislaying the X-ray image may be of a known type which is usually used. Since a dosage of X-ray at the photographing time is about 100 times as great as a dosage of X-ray under fluorescopic observation at the non-photographing time, it is necessary that in order to permit an observation to be effected on the TV monitor even at the photographing time the intensity of light at the photographing time be stopped down to make it equal to the intensity of light during the fluoroscopic observation time. Accordingly, the lens system 16 of the present invention includes a light control device 161. The light control device 161 is adapted to control intensity of light and it may be constructed using, for example, a diaphragm or a liquid crystal. The light control device 161 is driven by the X-ray exposure or command pulse and it is operated at the X-ray photographing time and adjusts intensity of light which is incident on the TV camera. By so doing, the magnitude in level of the video signal from the TV camera is made substantially constant irrespective of whether it is at the non-photographing exposure time or at the photographing exposure time. As shown in detail in FIG. 2, for example, the camera controller 18 effects a control between the TV camera 17 and the TV monitor 19 and is adapted to permit the video signal picked-up at the camera 17 to be displayed on the TV monitor 19. That is, the video signal from the TV camera 17 is delivered through a mixing amplifier 183 for mixing the input video signal, gain control circuit 184 for controlling the video signal gain, clamp circuit 185 for clamping the video signal with predetermined potential level, image enhancer 186 for enhancing the video signal, video circuit 182 for mixing the input signal, clamp circuit 187 and output amplifier 188 for amplifying the video signal to the TV monitor 19. A drive pulse generator 181 for synchronization, which displays the video signal picked-up by the camera 17 on the TV monitor 19, is provided in the camera controller and adapted to generate a horizontal drive pulse HD (a horizontal synchronizing frequency of an ordinary television receiver) and a vertical drive pulse VD (a vertical synchronizing frequency of the ordinary television receiver). According to this invention the video circuit 182 has a mixing function so as to permit ROI of the subject to be set while observing the X-ray image. That is, the video circuit 182 is constructed of an ordinary mixer circuit for mixing the video signal from the TV camera 17 and a gate pulse for display which comes from a pulse shaping circuit as will be set out later. When a mixed video signal is sent from the video circuit 182 to the TV monitor 19, the marginal edge of that area of the subject which is to be examined by the display gate pulse is indicated in a white line on the screen of the TV monitor 19. The above-mentioned pulse shaping circuit 20 is adapted to generate a display gate pulse for designating and displaying such predetermined area of the X-ray image and various other pulses for automatically X-ray photographing the predetermined area of the X-ray image at a proper timing. The pulse shaping cirucit 20 is shown in detail in FIG. 3. The pulse shaping circuit 20 receives the horizontal drive pulse HD and vertical driving pulse VD from the drive pule generator 181 in the camera controller 18 and provides the display gate pulse, sampling gate pulse and vertical gate pulse. The pulse shaping circuit 20 generates a set pulse upon closure of a start switch SW21. The display gate pulse is, as mentioned above, one for designating and displaying the predetermined area of the X-ray image, and the sampling gate pulse is one for sampling a video signal component, corresponding to the predetermined area of the X-ray image, from the video signal sent from the TV camera. The vertical gate pulse is a drive pulse for momentarily refreshing a change in level of a signal as occurring when a contrast medum pases through the predetermined area of the patient (subject). The set pulse is generated by the start switch SW21 adapted to be depressed when the patient drinks the contrast medium. The set pulse permits the ROI of the patient, as well as the X-ray photographing requirements, to be set and serves as a pulse for preparing an X-ray exposure for photographing. A horizontal block circuit 201 generates a horizontaldisplay gate pulse hh and samplng gate pulse ff. A time chart in FIG. 4 is explained at a horizontal rate for convenience of explanation. The horizontal drive pulse HD shown in FIG. 4*a* is passed through inverters 203 and 204 to generate a signal bb as shown in FIG. 4*b*. The signal bb is supplied to a monostable multivibrator 205 to generate a signal cc as shown in FIG. 4*c*. The signal cc of the monostable multivibrator 205 is supplied to monostable multivibrators 206 and 207 to generate signals dd and ee as shown in FIGS. 4*d* and 4*e*, respectively. The signal dd of the multivibrator 206 is passed through an inverter 208 and is extracted as the horizontal sampling gate pulse ff. The signal dd is also supplied to a monostable multivibrator 209, and a signal from the multivibrator 209, together with the signal ee of the multivibrator 207, is coupled to an NAND circuit 210 to generate the horizontal display gate pulse hh as shown in FIG. 4*h*. Each of resistors R1, R2, R3 and R4 is a variable resistor for adjustment which is provided in a corresponding one of the monostable multivibrators 205, 206, 207 and 209. The width and phase of each gate pulse can be freely varied by the corresponding one of the resistors R1 ... R4.

A vertical block circuit 202 is of the same construction as the horizontal block circuit 201. The vertical block circuit 202 generates a vertical sampling pulse ff' and vertical display gate pulse hh' in the same way as the horizontal block circuit 201. In consequence, the horizontal sampling gat pulse ff and vertical sampling gate pulse ff' are passed through a NAND circuit 211 and inverter 212 and extracted as the sampling gate pulse. The horizontal display pulse hh and vertical display pulse hh' are inverted at the inverters 213 and 214, respectively, and then supplied to a NAND circuit 215 to generate the display gate pulse. The vertical sampling gate pulse ff' is passed through the inverters 214' and 216 and extracted as a vertical gate pulse. Upon closure of the start switch SW21, an RS flip-flop 217 is turned ON and the output of the flip-flop 217 is passed through an inventer 218 and extracted as a set pulse.

The variable resistors R1, R2 or the corresponding variable resistors S1, S2 (not shown) of the vertical circuit 202 are constructed of Joy Stick which permits the simultaneous horizontal and vertical movement of the gate pulses on the screen as will be later described. In consequence, the position of the gate pulses can be arbitrarily changed n the screen. It is to be noted that the gate pulses appear at the central portion of the effective area of an X-ray image corresponding to the horizontal and vertical video signals.

Figure 5:
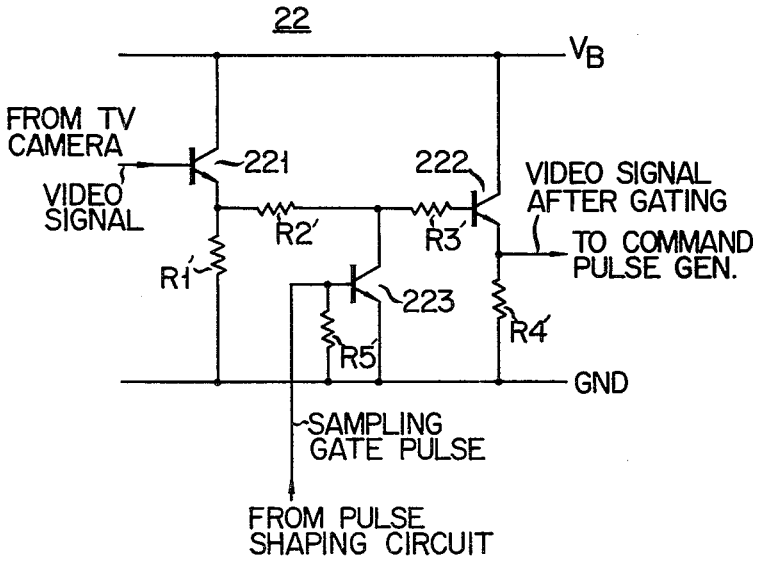
FIG. 5 is a detailed circuit showing a video gate circuit shown in FIG. 1.
Figure 6:
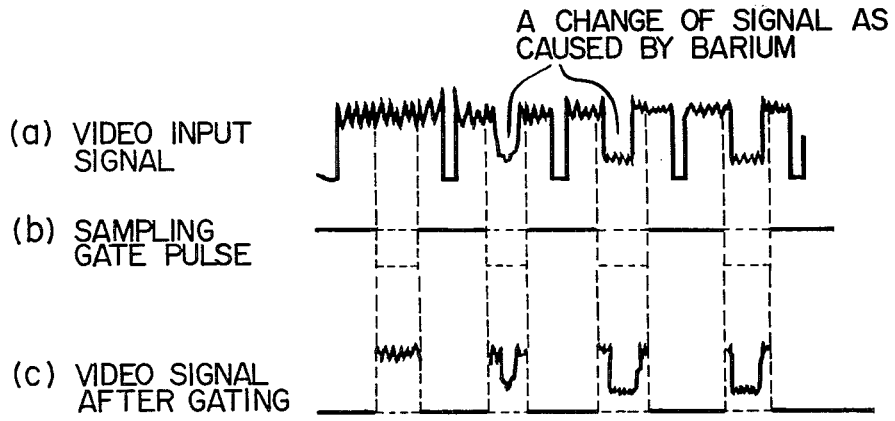
FIG. 6 is a time chart for explaining the circuit of FIG. 5.

Referring back to FIG. 1 the video signal obtained at the TV camera is applied to the video gate circuit 22 where a predetermined portion of the video signal is selected by a sampling gate pulse from the pulse shaping circuit 20. The detail of the video gate circuit 22 is shown in FIG. 5. An emitter-follower type input stage 221 and an emitter-follower type output stage 222 are connected between a power supply $V_B$ and ground. A gate stage 223 is connected between the input stage 221 and the output stage 222. Resistors R1' to R4' are for the purpose of providing respective stages. The video signal (FIG. 6*a*) applied to the base of the input stage 221 is controlled by the sampling pulse (FIG. 6*b*) applied to the base of the gate stage 223. The output of the output stage 222 is as shown in FIG. 6*c* in which a predetermined portion is extracted from the video signal.

Figure 8:
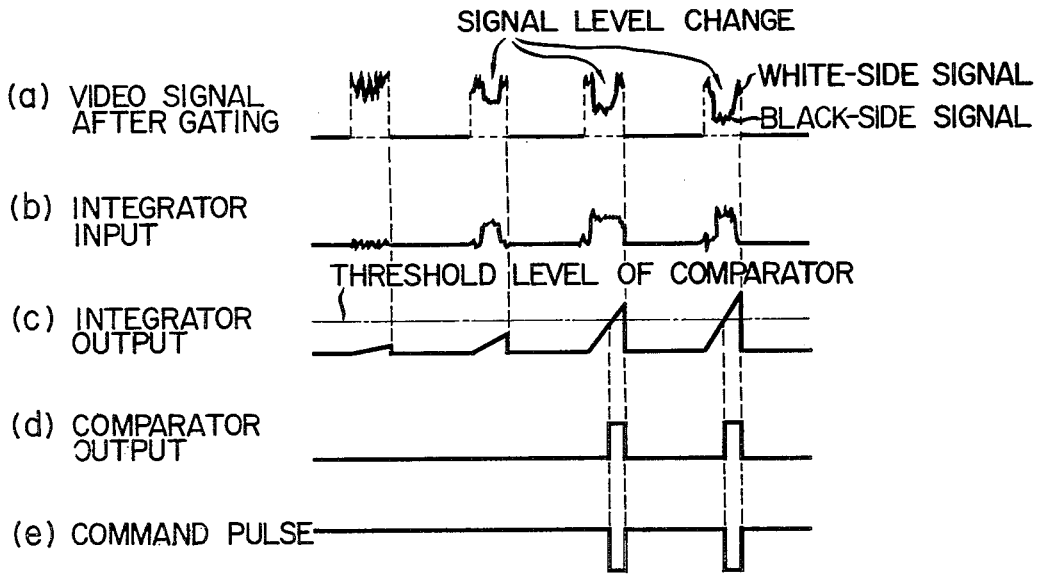
FIG. 8 is a time chart for explaining the circuit of FIG. 7.

In FIG. 1 the predetermined portion of the video signal from the video gate circuit 22 is fed to a command pulse generator 23. The command pulse generator 23 detects a change of the predetermined portion of the video signal as caused by the contrast mdium, for example, barium and generates an X-ray exposure command pulse for effecting an X-ray photographing when the signal reaches a predetermined level. The detail of the command pulse generator 23 is shown in FIG. 7. In FIG. 7, reference numral 231 is an inverting operational amplifier and 23, a clamp circuit. A video signal as shown in FIG. 8*a* is applied to the input terminal of the command pulse generator. The video signal is passed through the inverting operational amplifier 231 and clamp circuit 232 and only a signal component, as shown in FIG. 8*b*, resulting from the contrast medium is taken out. The integrator 233 receives the signal shown in FIG. 8*b* and generates an output waveform as shown in FIG. 8*c*. Reference numeral 234 shows a relay. The contact of the relay 234 is opened when the vertical gate pulse sent from the pulse shaping circuit 20 is in a negative direction and closed when the vertical gate pulse is in a positive direction. By the repetitive operation of the relay the integrator 233 is refreshed in synchronization with the vertical gate pulse. The threshold level of a comparator 235 is indicated by a dot-dash line in FIG. 8*c* and this level represents a voltage on the junction of a diode D. When the input of the comparator 235 i.e. the output of the integrator 233 exceeds the threshold potential, the comparator 235 produces an output pulse as shown in FIG. 8*d*. The output of the comparator 234 is inverted by an output stage transistor 236. As a result, a command pulse as shown in FIG. 8*e* is generated from the command pulse generator 23.

Referring back to FIG. 1 the command pulse of the command pulse generator 23 is supplied to an X-ray controller 24. The X-ray controller 24 is adapted to after receipt of a set pulse from the pulse shaping circuit 20, receive a first command pulse sent from the command pulse generator 23 and generate a pulse for driving a high voltage generator 25. The X-ray controller 24 is of a known normal type and only a circuit portion relating to this invention is shown in FIG. 9.

Figure 9:
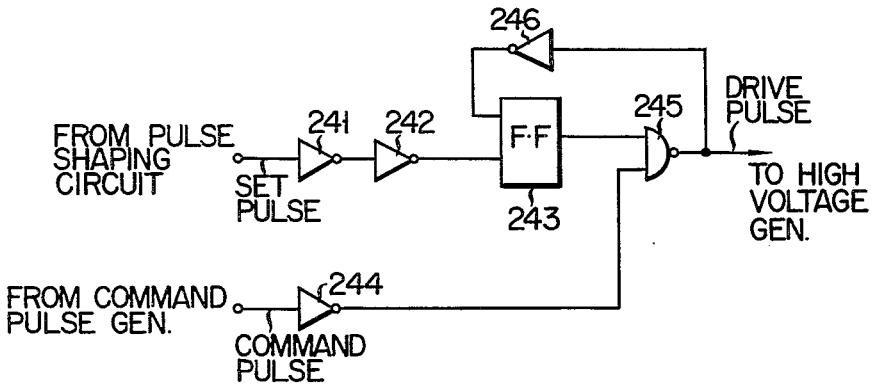
FIG. 9 is a circuit showing that part of an X-ray controller in FIG. 1 which is associated with this invention.
Figure 10:
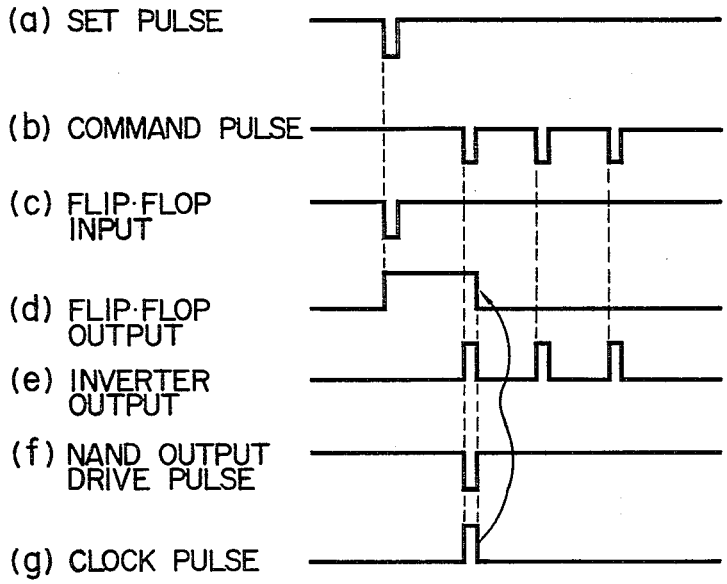
FIG. 10 is a time chart for explaining the circuit in FIG. 9.

In FIG. 9 the set pulse as shown in FIG. 10*a* is passed through inverters 241 and 242 and extracted as a signal as shown in FIG. 10*c*. When the signal (FIG. 10*c*) is applied to a flip-flop 243, the flip-flop 243 is set as shown in FIG. 10*d*. The command pulse as shown in FIG. 10*b* is inverted by an inverter 244 and a signal as shown in FIG. 10*e* appears from the inverter 244. The output of the flip-flop 243 and output of the inverter 244 are applied to a NAND circuit 245 to generate a signal as shown in FIG. 10*f*. The output of the NAND circuit 245 is inverted by the inverter 246 and a clock pulse as shown in FIG. 10*g* appears from the inverter 1246. When the input of the flip-flop 243 is negative, the output of the flip-flop 243 is locked positive irrespective of whether the clock pulse is positive or negative. When as shown the clock pulse is shifted from the positive to the negative level the flip-flop 243 is reset.

The high voltage generator 25 supplied a signal of predetermined current/voltage to the X-ray tube 11 upon receipt of the above-mentioned drive pulse to permit an X-ray beam for X-ray photographing a ROT of the subject to be generated from the X-ray tube 11.

Although the arrangement of the X-ray apparatus shown in FIG. 1 has been explained in connection with a direct X-ray photographing, this invention can also be applied to an II type indirect photographing in which an X-ray image on the output screen of the image intensifier 15 is photographed and to a monitor type indirect photographing in which an X-ray image on theTV monitor 19 is photographed.

Figure 11:
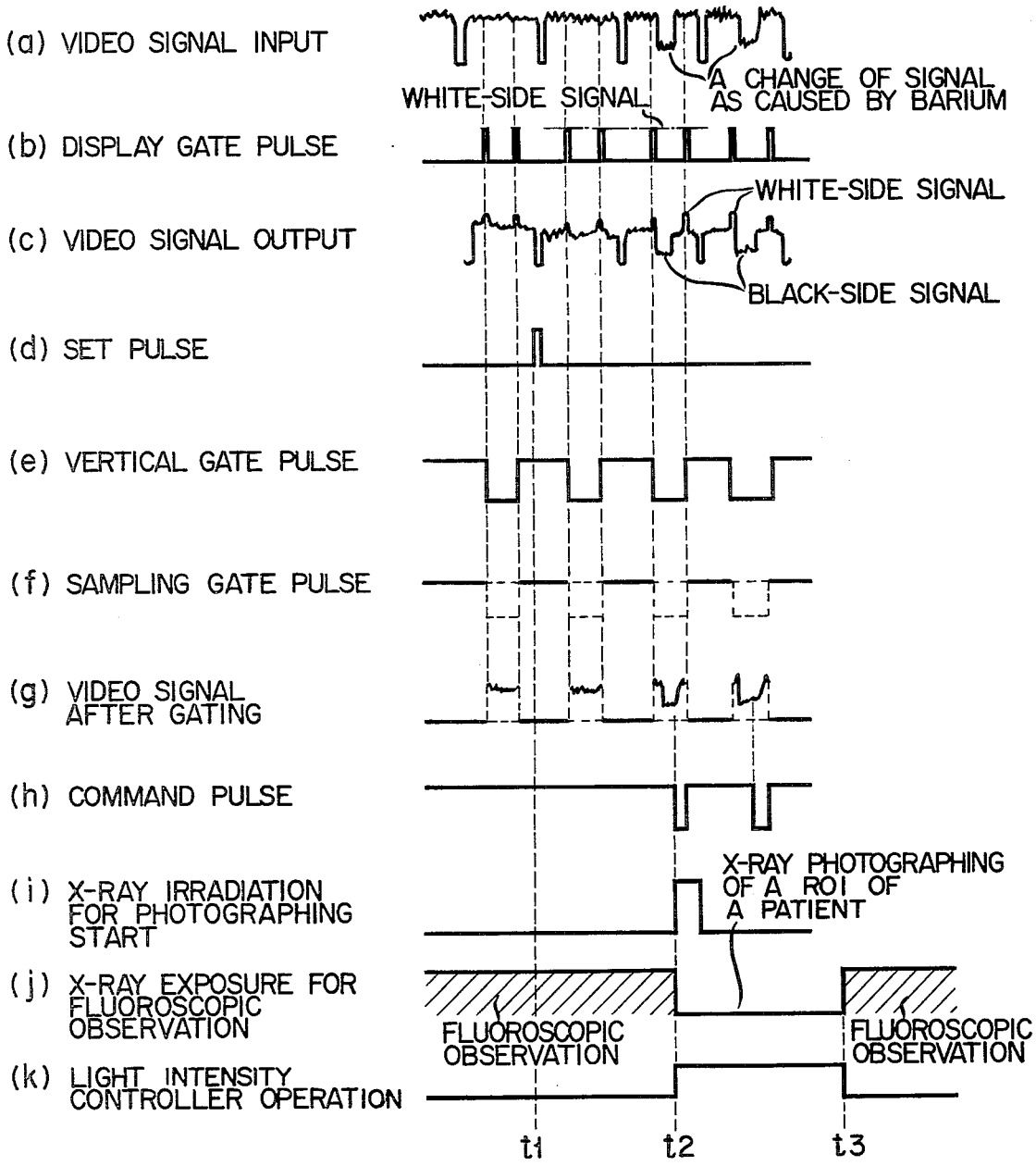
FIG. 11 is a time chart for explaining the operation of the X-ray apparatus in FIG. 1.

The operation of the X-ray apparatus according to this invention will be explained below by referring to a time chart in FIG. 11. The time chart shown in FIG. 11 is displayed at the vertical rate for convenience of explanation. The subject 12 is exposured with an X-ray beam, as shown in FIG. 1*j*, which is emitted from the X-ray tube 11 controlled by the X-ray controller 24. A dosage of X-ray at this time is very small, of the order of about 1/100, in comparison with a dosage of X-ray to be irradiated for photographing. The film (cassette) 14 is in the "wait" position A. The X-ray penetrated through the subject 12 is sent to the image intensifier 15 where it is subjected to a photelectric conversion. The photoelectrically converted signal is sent through the lens system 16 to the TV camera 17 to generate a video signal shown in FIG. 11*a*. The video signal is supplied to the video circuit 182 in the camera controller 18 where it is mixed with the display gate pulse, as shown in FIG. 11*b*, which is sent from the pulse shaping circuit 20. The video signal is supplied to the TV monitor 19 where an X-ray image is displayed. The above-mentioned display gate pulse indicates the central portion of the X-ray image on the screen and, if for example at a white level, it appears as a white line encircling, for example, an esophagus. The position of the white line and its extent of encircling can be properly adjusted, while observing the X-ray image on the screen, by varying the phase or the width of the pulse (through the variable resistors R1, R2 to S1, S2 in FIG. 3). the ROI of the subject is set by this adjustment. Then, the operator instructs the patient to drink the contrast medium (barium) and the start switch 21 for photographing is depressed at the time when the patient drinks it. Up to the time $t_1$ the above-mentioned operation is effected.

When at time $t_1$ the start switch is depressed, the pulse shaping circuit 20 delivers a set pulse as shown in FIG. 11*d* to the X-ray controller 24 to cause the latter to be in a "machine ready" state. When the contrast medium is sent to the to-be-examined area, for example, the esophagus, of the patient, a signal are the TV camera 17 becomes a signal waveform of which the central portion is dipped, as shown in FIG. 11*a*, due to the level of the signal being varied by the contrast medium.

The video signal from the TV camera 17 leads to the Video gate circuit 22 where a signal component corresponding to the ROI of the subject is selected from the video signalby a sampling pulse, as shown in FIG. 11*f*, which is sent frm the pulse shaping circuit 20. The selected video signal component is supplied to the command pulse generator 23. The command pulse generator 23 generates a command pulse as shown in FIG. 11*h* when a variation in level of the signal exceeds a predetermined threshold level.

When at time $t_2$ the command signal is generated from the command pulse generator, it is supplied to the X-ray controller 24. Upon receipt of the command signal the X-ray controller 24 generates an X-ray drive pulse shown in FIG. 11*i*) for photographing,which is sent to the high voltage circuit 25. The high voltage circuit 25 provides a predetermined current and voltage for X-ray photographing to the X-ray tube 11 for drive. In consequence, an X-ray is emitted from the X-ray tube 11 toward a predetermined area (esophagus) of the subject.

In this case, a much more intense light than a light under observation is emitted from the image intensifier 15. When, therefore, the ight from the image intensifier 15 is conducted through a lens system 16 to the TV camera 17, a video signal with a very large potential level is obtained, causing inconvenience to the X-ray device. As shown in FIg. 11*k*, therefore, the light controller 161 is driven by a command pulse so as to make intensity of light at the photographing time substantially equal to intensity of light under fluorescopic observation. In consequence, substantially the same level of video signal is obtained from the TV camera irrespective of whether at the X-ray photographing time or under observation.

At time $t_2$ to $t_3$ the predetermined area of the subject through which the contrast medium is passed is X-ray photographed. That is, when the command pulse is inputted to the X-ray controller 24 the following series of X-ray photographings is automatically carried out:

(1) the stopping of the X-ray exposure for fluoroscopic observation (2) the movement of the film (cassette) 14 from the "wait" position A to the "photograph" position B.

(3) the irradiation of the subject with a photographing X-ray (a quantity of X-ray at this time is about 100 times as large as that at the step (1) — the photographing step is complete (49 the interruption of a supply of the X-ray by a photo-timer not shown (5) the movement of the cassette film back to the "wait" position A (b 6) the starting of the X-ray exposure for fluoroscopic observation From the time $t_3$another area of the subject is set while observing the X-ray image on the TV monitor. A subsequent photographing is automatically effected in the same manner as mentioned above.

With the X-ray apparatus according to this invention any ROI of the patient such as an esophagus, blood vessels of the heart etc., through which a contrast medium is passed at high speed, can be readily X-ray photographed at all times in a uniform good picture quality irrespective of whether the operator is skilled or not.

What is claimed is:

1. An X-ray apparatus for diagnosis which utilizes an X-ray television system, comprising video circuit means for designating and setting on an X-ray television device any partiular area of an X-ray image which is sent from a subject to be X-ray photographed; gate means for selecting a predetermined signal component from video signal corresponding to the X-ray image; signal detection means for detecting a variation of the selected video signal component and generating an X-ray exposure command signal when the variation of the video signal component reaches a predetermined level.

2. The X-ray apparatus according to claim 1, further comprising a pulse forming means for forming a pulse for giving a start timing for X-ray photographing the predetermined area of the subject through which a constrast medium is passed, a gate pulse supplied to said video circuit means to set and display the predetermined area of the X-ray image, a gate pulse supplied to said gate means to sample said predetermined video signal component, and a pulse supplied to said signal detection means to cause the latter to be refreshed.

3. The X-ray apparatus according to claim 1, in which a variation of the selected video signal component is caused by a contrast medium.

4. The X-ray apparatus according to claim 2, in which said pulse forming means includes a plurality of monostable multivibrators and resistors each adapted to adjust the width or the phase of an output pulse of the corresponding multivibrator, in which the width or the phase of each gate pulse is varied by making the adjustment resistor variable.

5. The X-ray apparatus according to claim 2, in which said video circuit means comprises a mixer amplifier circuit for mixing the video signal corresponding to the X-ray image with the gate pulse for display.

6. The X-ray apparatus according to claim 2, in which said gate means includes first and second emitter follower type stages connected between a power supply line and ground and a gate stage connected between the first and second stages in which the video signal applied to the gate of the first stage is controlled by a sampling pulse applied to the gate of said gate stage to select the predetermined signal component from the video signal, and the predetermined video signal component is delivered from the second stage.

7. The X-ray apparatus according to claim 1, in which said detection means comprises an inverting amplifier for inverting and amplifying the selected predetermined video signal comonent, a clamp circuit connected to the output of said inverting amplifier, an integrator for integrating the output of said clamp circuit, and a comparator for comparing the output of said integrator and a threshold level determined by said detection means, in which a variation in level of said video signal is detected by the integrator and a corresponding amount of variation is checked by the comparator.

8. The X-ray apparatus according to claim 7, in which said integrator is constructed of an operational amplifier and refreshed in synchronism with the vertical gate pulse by opening and closing a relay adapted to be driven by the vertical gate pulse from said pulse forming means.

9. The X-ray apparatus according to claim 2, further including an X-ray controller comprising a flip-flop set by a timing set pulse from said pulse forming means, an inverter for inverting an X-ray exposure command signal from the detection means, and a NAND circuit for enabling the output of the flip-flop and the output of the inverter, said X-ray controller being adapted to receive, after said flip-flop has been set by said set pulse, said exposure command signal and generate a drive pulse for driving a photographing X-ray.

10. The X-ray apparatus according to claim 1, in which an optical system in said X-ray television device has a light control means for controlling the intensity of light by reducing the intensity of light at the photographing time and make it equal to intensity of light during the fluoroscopical observation time.

* * * * *